US005140897A

United States Patent [19]

Olson

[11] Patent Number: 5,140,897

[45] Date of Patent: Aug. 25, 1992

[54] EXTENDED NIP PRESS APPARATUS

[75] Inventor: Stewart B. Olson, Lexington, Ky.

[73] Assignee: Beloit Corporation, Beloit, Wis.

[21] Appl. No.: 391,347

[22] Filed: Aug. 9, 1989

[51] Int. Cl.[5] ..... B30B 3/00

[52] U.S. Cl. ..... 100/153; 100/162 B; 162/358.3

[58] Field of Search ..... 100/118, 151, 153, 162 B, 100/37; 162/358, 361

[56] References Cited

U.S. PATENT DOCUMENTS

| | | | |
|---|---|---|---|
| 4,428,797 | 1/1984 | Cronin | 100/153 X |
| 4,468,287 | 8/1984 | Dahl | 162/358 |
| 4,556,454 | 12/1985 | Dahl et al. | 100/153 X |
| 4,570,314 | 2/1986 | Holik et al. | 100/162 B X |

FOREIGN PATENT DOCUMENTS

| | | | |
|---|---|---|---|
| 0107607 | 5/1984 | European Pat. Off. | 162/358 |

*Primary Examiner*—Harvey C. Hornsby

*Assistant Examiner*—Stephen F. Gerrity

*Attorney, Agent, or Firm*—Dirk J. Veneman; Raymond W. Campbell; David J. Archer

[57] ABSTRACT

An extended nip press apparatus is disclosed for pressing water from a formed web. The apparatus includes a frame and an elongate shoe pivotally supported by the frame. A backing roll cooperates with the shoe for defining therebetween an extended nip for the passage therethrough of the web. The backing roll includes a beam which extends in a cross-machine direction, the beam being rigidly supported by the frame. A roll shell is rotatably supported by the beam, the roll shell cooperating with the shoe for defining the extended nip. A plurality of roll shell deflection compensating devices are disposed in a cross-machine direction between the roll shell and the beam for urging the roll shell towards the elongate shoe and for compensating for deflection of the roll shell relative to the shoe during passage of the web through the extended nip.

7 Claims, 2 Drawing Sheets

EXTENDED NIP PRESS APPARATUS

BACKGROUND OF THE INVENTION

1. Field of the Invention

This invention relates to an extended nip press apparatus for pressing water from a formed web. More particularly, the present invention relates to an extended nip press apparatus which includes a deflection compensating backing roll which supplies the force necessary to urge the backing roll and the elongate press shoe towards each other for pressing a web extending therethrough.

2. Information Disclosure Statement

With the introduction of the extended nip press, the amount of water removed from the formed web during the pressing operation was greatly increased when compared with the more conventional nipping techniques incorporating a pair of counter-rotating rolls.

The extended nip press includes essentially an elongate pressing shoe defining a concave surface which is pressed into close conformity with a backing roll thereby defining therebetween an elongate pressing nip. A press blanket extends through the extended nip with the blanket moving through the extended nip and relative to the elongate pressing shoe. The press blanket is lubricated on the inner surface thereof so that the blanket slides over the shoe and through the extended nip. Typically, one or more press felts extend through the extended nip. Such press felts extend through the extended nip between the press blanket and the backing roll with the formed web being disposed between the press felts.

Because of the high pressures involved and the extended dwell time of the formed web within the extended press nip, an improved water removing capability is achieved with the extended nip press compared with the more conventional press nips.

However, in the prior art, the press shoe is usually hydraulically urged towards the press blanket. One prior art extended nip press includes a piston which slides relative to a cylinder controllably connected to a source of hydraulic pressure such that on application of hydraulic pressure, the piston or elongate press shoe is urged into conformity with the backing roll. However, such pistons require relatively complex sealing means and are difficult to seal, particularly when a plurality of such pistons are provided along the cross-machine direction.

Another type of extended nip press includes a hydraulically urged piston which is connected to the elongate shoe by means of an elongate rod extending in a cross-machine direction thereby permitting the shoe to pivot relative to the piston.

A third means of urging the press blanket into close conformity with the backing roll includes the provision of hydrostatic bearing means whereby hydraulic pressure is applied directly to the press blanket. The edges of the press blanket are sealed in order to maintain hydrostatic pressure against the press blanket.

All of the aforementioned techniques are relatively complex and typically it is necessary to provide a backup extended nip press arrangement so that in the event of sealing failure, the backup arrangement can be brought into operation so that production is not unduly affected.

Such backup equipment is expensive and relatively difficult to install. The present invention seeks to overcome the aforementioned problem by eliminating the aforementioned relatively complex seal arrangements by using the hydraulic pressure exerted by means of a deflection compensated backing roll for providing the necessary pressing force for urging the backing roll into close conformity with the elongate pressing shoe.

Therefore, it is a primary object of the present invention to provide an extended nip press apparatus which overcomes the aforementioned inadequacies of the prior art devices and which makes a considerable contribution to the art of pressing water from a formed web.

Another object of the present invention is the provision of an elongate press shoe which is pivotally supported directly to a press frame and of providing a backing roll including a roll shell deflection compensating means for urging the roll shell towards the elongate shoe and for compensating for deflection of the roll shell relative to the shoe during passage of the web through the extended nip.

Another object of the present invention is the provision of an extended nip press apparatus in which the frame defines an elongate groove, the apparatus also includes a rod which extends in a cross-machine direction with the rod being partially disposed within the elongate groove and the shoe defines a further groove for the partial reception therein of the rod so that the shoe is permitted to pivot relative to the frame.

Another object of the present invention is the provision of an extended nip press apparatus in which the shell deflection compensating means includes a plurality of hydrostatic bearings which are disposed between the shell and a beam in a cross-machine direction for urging the shell into conformity with the elongate shoe.

Another object of the present invention is the provision of an extended nip apparatus in which each of the plurality of roll shell deflection compensating means includes a cylinder defined by the beam, the cylinder being controllably connected to a source of hydraulic pressure and a piston slidably cooperating within the cylinder such that when the cylinder is connected to the source of hydraulic pressure, the piston is urged towards the elongate shoe such that the roll shell is urged into conformity with the elongate shoe for pressing water from the web extending through the extended nip.

Other objects and advantages of the present invention will be apparent to those skilled in the art by consideration of the detailed description taken in conjunction with the annexed drawings.

SUMMARY OF THE INVENTION

The present invention relates to an extended nip press apparatus and method for pressing water from a formed web. The apparatus includes a frame and an elongate press shoe which is supported by the frame. A backing roll cooperates with the elongate shoe for defining therebetween an extended nip for the passage therethrough of the web. The backing roll includes a beam which extends in a cross-machine direction, the beam being rigidly supported by the frame. A roll shell is rotatably supported by the beam with the roll shell cooperating with the shoe for defining the extended nip. A plurality of roll shell deflection compensating devices are disposed between the roll shell and the beam for urging the roll shell towards the elongate shoe and for compensating for deflection of the roll shell relative to the shoe during passage of the web through the extended nip.

In a more specific embodiment of the present invention, the frame defines an elongate groove with the frame further including an elongate rod which extends in a cross-machine direction, the rod being partially disposed within the elongate groove. The elongate shoe defines a further groove for the partial reception therein of the rod so that the shoe is permitted to pivot relative to the frame.

The shoe also defines a concave surface which cooperates with the backing roll for defining therebetween the extended nip.

The beam has a first and a second end which are rigidly secured to the frame, and the beam also includes a first and a second bearing which are disposed adjacent to the first and the second ends of the beam respectively for rotatably supporting the roll shell.

The roll shell has an axis of rotation which is disposed parallel and spaced relative to a further axis of rotation of the elongate rod.

The plurality of roll shell deflection compensating means also includes a plurality of hydrostatic bearings which are disposed between the shell and the beam and disposed in a cross-machine direction for urging the shell into conformity with the elongate shoe.

In another embodiment of the present invention, the plurality of roll shell deflection compensating means each include a cylinder defined by the beam with the cylinder being controllably connected to a source of hydraulic pressure. A piston slidably cooperates with the cylinder such that when the cylinder is connected to the source of hydraulic pressure, the piston is urged towards the elongate shoe such that the roll shell is urged into conformity with the elongate shoe for pressing water from the web extending through the extended nip.

The present invention also includes a method for pressing water from a formed web extending through an extended nip press apparatus, said method comprising the steps of:

1) passing the web through an extended nip defined between an elongate shoe pivotally supported by a frame and a backing roll which cooperates with the shoe for defining therebetween the extended nip; and
2) urging the backing roll towards the elongate shoe by means of a plurality of roll shell deflection compensating means disposed in a cross-machine direction between a roll shell and a beam such that the roll shell is urged towards the elongate shoe and for compensating for deflection of the roll shell relative to the shoe during passage of the web through the extended nip.

Many modifications and variations of the present invention will become readily apparent to those skilled in the art by a consideration of the detailed descriptions taken in conjunction with the annexed drawings. Such modifications and variations, however, fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
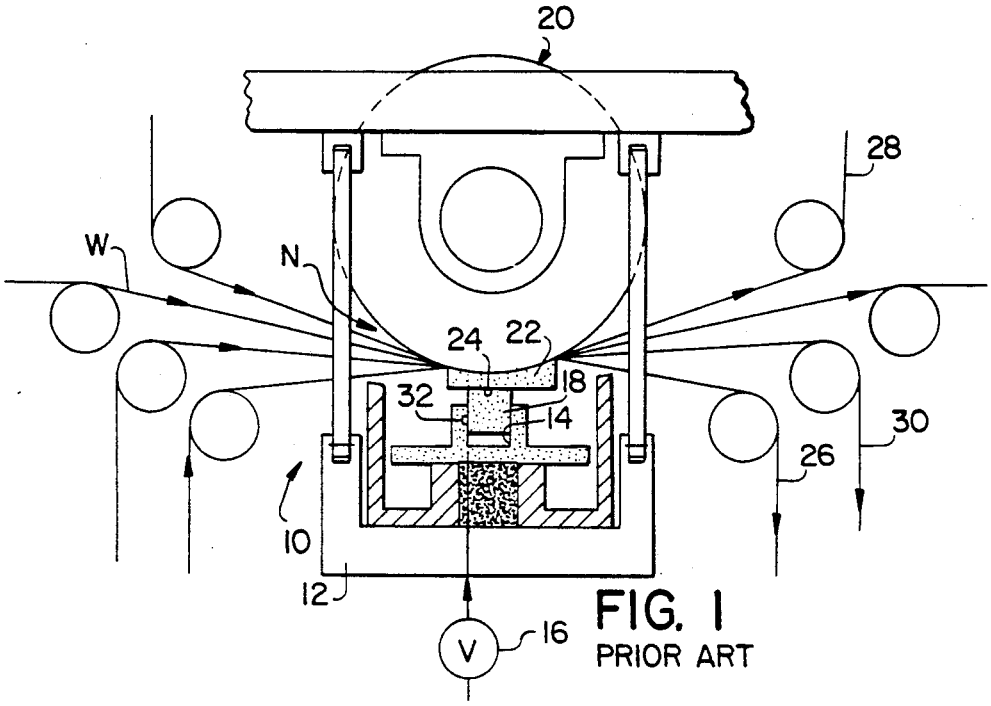
FIG. 1 PRIOR ART
FIG. 1 is a side-elevational view of a typical prior art extended nip press apparatus showing an elongate shoe urged by hydraulic pressure towards a backing roll.

FIG. 1 is a side-elevational view of a prior art extended nip press apparatus generally designated 10. The press apparatus 10 includes a frame 12 and a cylinder 14 controllably connected to a source of hydraulic pressure 16. A piston 18 slidably cooperates with the cylinder 14 such that when the cylinder is connected to the source of hydraulic pressure 16, the piston 18 is urged upwardly towards a backing roll generally designated 20. The piston 18 is connected to an elongate press shoe 22 by means of a pivoting rod 24 such that pressure is transmitted from the piston 18 to the elongate pressing shoe 22. A press, blanket 26 is disposed between the press shoe 22 and the backing roll 20 so that an extended nip generally designated N is defined between the press blanket 26 and the cooperating backing roll 20. A web W extends through the extended nip N with a first and a second press felt 28 and 30 respectively disposed on opposite sides of the web W.

Typically, the piston 18 slidably engaging the cylinder 14 requires relatively complex sealing arrangements 32 so that adequate pressure is maintained at the extended nip N. In the event of such seal 32 leaking, the whole assembly of the cylinder 14, piston 18 and the press shoe 22 must be removed and replaced in order to maintain production with the minimum of delay.

Figure 2:
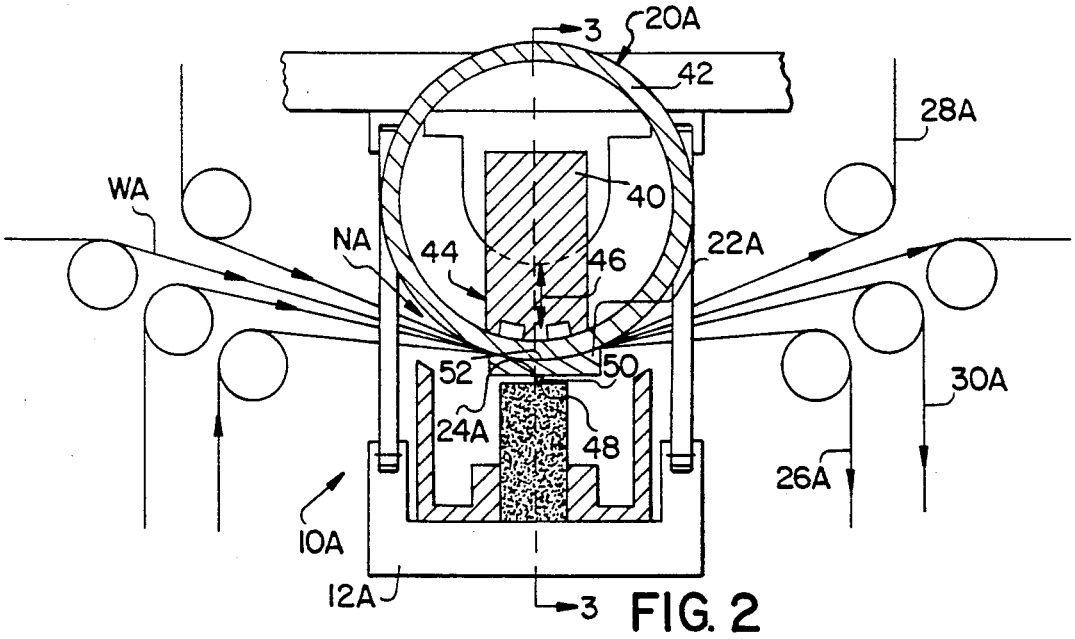
FIG. 2 is a side-elevational view of an extended nip press apparatus according to the present invention showing a backing roll including a plurality of hydrostatic bearings disposed between the shell and a support beam.

The present invention overcomes the aforementioned problem by providing an extended nip press apparatus generally designated 10A, as shown in FIG. 2, for pressing water from a formed web WA. The apparatus 10A, according to FIG. 2, includes a frame 12A and an elongate shoe 22A which is pivotally supported at 24A by the frame 12A. A backing roll 20A cooperates with the shoe 22A for defining therebetween an extended nip NA for the passage therethrough of a web WA. The backing roll 20A includes a beam 40 which extends in a cross-machine direction. The beam 40 is rigidly supported by the frame 12A. A roll shell 42 is rotatably supported by the beam 40 with the roll shell 42 cooperating with the shoe 22A for defining the extended nip NA. A plurality of roll shell deflection compensating means generally designated 44 are disposed in a cross-machine direction between the roll shell 42 and the beam 40 for urging the roll shell 42 towards the elongate shoe 22A and for compensating for deflection of the roll shell 42 as indicated by the arrow 46 relative to the shoe 22A during passage of the web WA through the extended nip NA.

More specifically, as shown in FIG. 2, the frame 12A also defines an elongate groove 48. The frame 12A also includes an elongate rod 24A which extends in a cross-machine direction. The rod 24A is partially disposed within the elongate groove 48. The elongate shoe 22A defines a further groove 50 for the partial reception therein of the rod 24A so that the shoe 22A is permitted to pivot relative to the frame 12A.

As shown in FIG. 2, the elongate shoe 22A defines a concave surface 52 for cooperation with the backing roll 20A for defining the extended nip NA therebetween.

Figure 3:
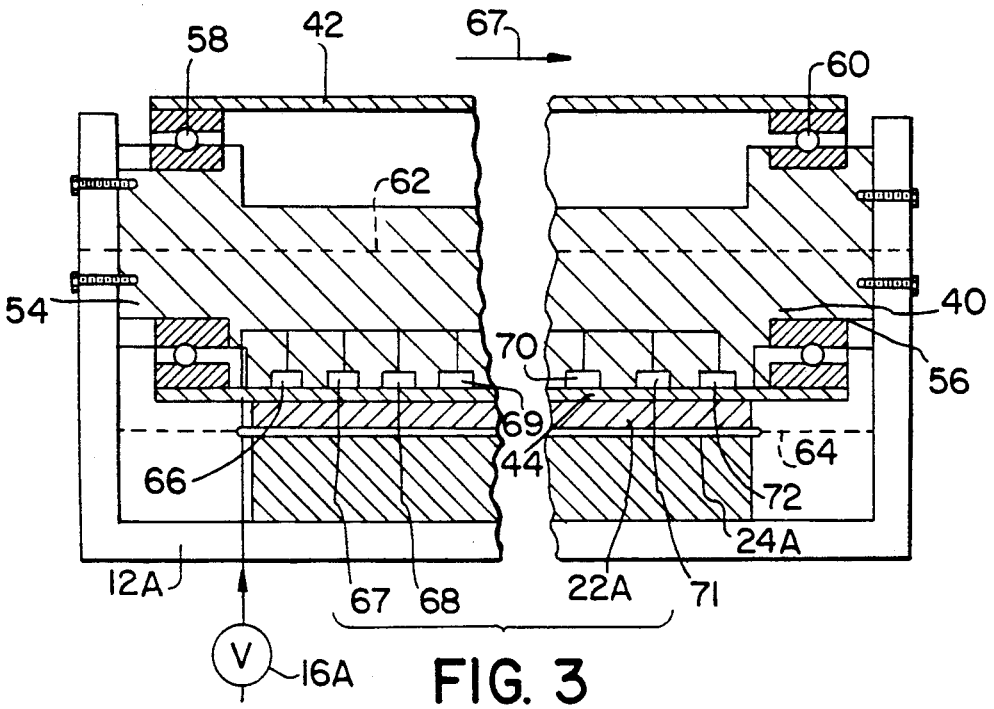
FIG. 3 is an sectional view taken on line 3—3 of FIG. 2 showing a plurality of hydrostatic bearings.

FIG. 3 is a fragmentary sectional view on the line 3—3 of FIG. 2 and shows the beam 40 having a first and a second end 54 and 56 respectively. The ends 54 and 56 are rigidly secured to the frame 12*a*.

The beam 40 also includes a first and a second bearing 58 and 60 respectively which are disposed adjacent to the first and second ends 54 and 56 respectively of the beam 40 for rotatably supporting the roll shell 42.

The roll shell 42 has an axis of rotation 62 which is disposed parallel and spaced relative to a further axis of rotation 64 of the elongate rod 24A.

As shown in FIG. 3, the plurality of roll shell deflection compensating means 44 also includes a plurality of hydrostatic bearings 66,67,68,69,70,71,72 which are disposed between the shell 42 and the beam 40 in a cross-machine direction as indicated by the arrow CM for urging the shell 42 into conformity with the elongate shoe 22A.

Figure 4:
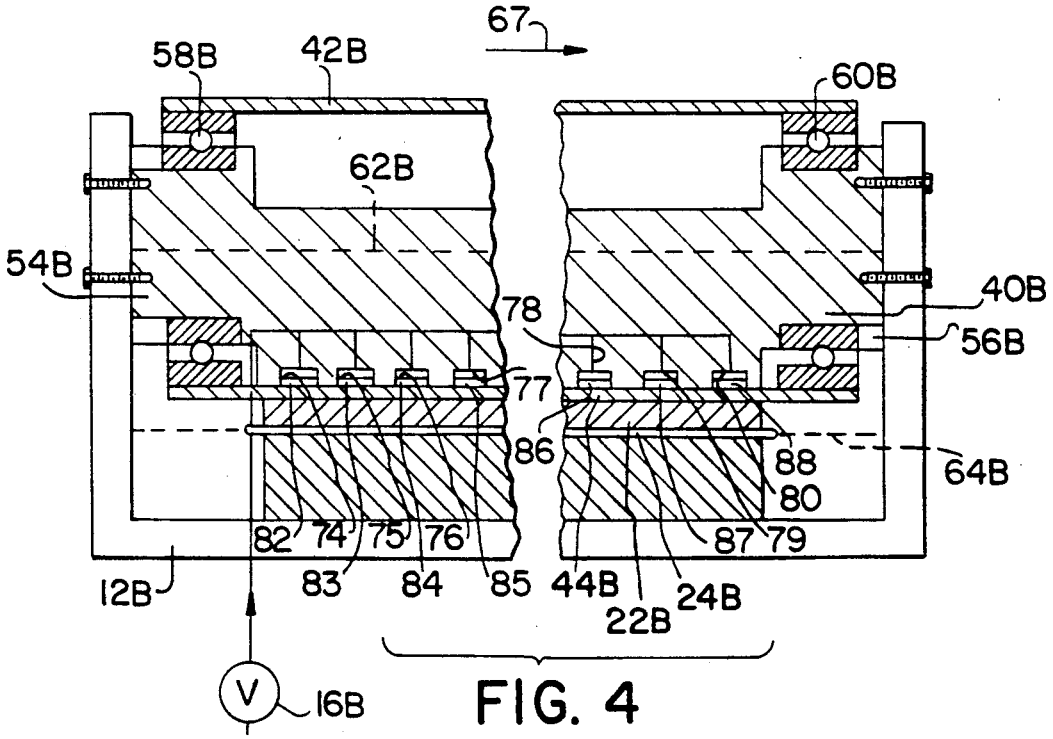
FIG. 4 is a similar view to that shown in FIG. 3 but shows an alternative embodiment including a plurality of pistons.

FIG. 4 is a view similar to that shown in FIG. 3 but shows another embodiment of the present invention in which a plurality of roll shell compensating means 44B include cylinders 74,75,76,77,78,79,80 defined by the beam 40B. The cylinders 74–80, are controllably connected to a source of hydraulic pressure 16B. Pistons 82,83,84,85,86,87,88 slidably cooperate within the cylinders 74–80 such that when the cylinders 74–80 are connected to the source of hydraulic pressure 16B, the pistons 82–88 are urged towards the elongate shoe 22B such that the roll shell 42B is urged into conformity with the elongate shoe 22B for pressing water from the web extending through the extended nip.

The present invention provides a simple and inexpensive means of providing the necessary pressing pressure between the elongate shoe and the cooperating backing roll while avoiding the unnecessary cost of providing a piston and seal arrangement for urging the shoe into conformity with the backing roll.

What is claimed is:

1. An extended nip press apparatus for pressing water from a formed web, said apparatus comprising:

a frame;

an elongate shoe pivotally supported by said frame;

a backing roll cooperating with said shoe for defining therebetween an extended nip for the passage therethrough of the web;

said backing roll including: a beam extending in a cross-machine direction, said beam being rigidly supported by said frame;

a roll shell rotatably supported by said beam, said roll shell cooperating with said shoe for defining said extended nip;

a plurality of roll shell deflection compensating means disposed in a cross-machine direction between said roll shell and said beam for urging said roll shell towards said elongate shoe and for compensating for deflection of said roll shell relative to said shoe during passage of the web through said extended nip; and said beam having a first and a second end, said first and second ends of said beam being rigidly supported by said frame.

2. An extended nip apparatus as set forth in claim 1 wherein said frame defines a cross-machine direction groove;

said frame further including:

an elongate rod partially disposed within said elongate groove;

said elongate shoe defining a further elongate groove such that said rod is partially disposed within said further groove so that said elongate shoe is permitted to pivot relative to said frame.

3. An extended nip apparatus as set forth in claim 2 wherein said roll shell has an axis of rotation which is disposed parallel and spaced relative to a further axis of rotation of said elongate rod.

4. An extended nip apparatus as set forth in claim 1 wherein said elongate shoe defines a concave surface which cooperates with said backing roll for defining said extended nip.

5. An extended nip apparatus as set forth in claim 1 wherein said beam further includes:

a first and a second bearing disposed adjacent to said first and second ends of said beam respectively for rotatably supporting said roll shell.

6. An extended nip apparatus as set forth in claim 1 wherein said plurality of roll shell deflection compensating means further include:

a plurality of hydrostatic bearings disposed between said shell and said beam in a cross-machine direction for urging said shell into conformity with said elongate shoe.

7. An extended nip apparatus as set forth in claim 1 wherein each of said plurality of roll shell deflection compensating means further include:

a cylinder defined by said beam, said cylinder being controllably connected to a source of hydraulic pressure;

a piston slidably cooperating with said cylinder such that when said cylinder is connected to said source of hydraulic pressure, said piston is urged towards said elongate shoe such that said roll shell is urged into conformity with said elongate shoe for pressing water from the web extending through said extended nip.

* * * * *